US006114899A

United States Patent [19]

Jang et al.

[11] Patent Number: 6,114,899

[45] Date of Patent: Sep. 5, 2000

[54] VARIABLE VOLTAGE DRIVER CIRCUIT USING CURRENT DETECTOR

[75] Inventors: Ki-Ho Jang, Gyunggi-do; Chang-Woon Choi, Seoul, both of Rep. of Korea

[73] Assignee: Hyundai Electronics Industries Co., Ltd., Yicheon-shi, Rep. of Korea

[21] Appl. No.: 09/200,450

[22] Filed: Nov. 27, 1998

[30] Foreign Application Priority Data

Dec. 31, 1997 [KR] Rep. of Korea ..... 97-82295

[51] Int. Cl.[7] ..... G05F 3/02

[52] U.S. Cl. ..... 327/540; 327/538

[58] Field of Search ..... 327/540, 530, 327/538, 541, 543; 323/313

[56] References Cited

U.S. PATENT DOCUMENTS 4,837,457 6/1989 Bergstrom et al. ..... 307/253
5,430,682 7/1995 Ishikawa et al. ..... 365/226
5,499,209 3/1996 Oowaki et al. ..... 365/189.11

*Primary Examiner*—Toan Tran
*Assistant Examiner*—Linh Nguyen
*Attorney, Agent, or Firm*—Oliff & Berridge, PLC

[57] ABSTRACT

A variable voltage driver circuit using a current detector is disclosed. The circuit includes a voltage generator, a voltage detector for detecting an output voltage of the voltage generator, a delay unit connected with the voltage detector for feeding back a signal to the voltage generator, a pulse generator for receiving a signal from the voltage generator and generating a pulse, a current-pulse generator for detecting a current in accordance with a signal from the pulse generator, a voltage drop detector for detecting a voltage dropped in the signal from the current-pulse generator, a latch for storing a signal from the voltage drop detector, and an extra-voltage driver for supplying a current in accordance with a latch signal when the current is small. In the present invention, when a normal voltage is generated by the voltage generator, the current supplied from the driver is measured. As a result of the measurement, if the current is small, the current is supplied by driving the extra-voltage driver.

4 Claims, 3 Drawing Sheets

VARIABLE VOLTAGE DRIVER CIRCUIT USING CURRENT DETECTOR

BACKGROUND OF THE INVENTION

1. Field of the Invention

The present invention relates to an internal voltage generator for a semiconductor device, and in particular, to an improved variable voltage driver circuit using a current detector which is capable of variably adapting a current supply capacity to a semiconductor device by measuring voltage and current generated by an internal voltage generator.

2. Description of the Conventional Art

The voltage generator for a semiconductor device implemented by a semiconductor CMOS process is generally formed of a current mirror and a differential amplifier or a circuit generating a voltage using a ring oscillator and a charge pump and a driver generating a current used for the operation of a device based on the thusly generated voltage. At this time, in the thusly constituted conventional circuit, the operation of the voltage generator is stopped when a normal voltage is maintained using the voltage detector for an effective operation of the circuit. In addition, since there is not an information about the current used for the voltage generator, it is difficult to properly drive the current of the driver circuit. In this case, the driving capacity of the driver circuit is determined based on a simulation using a predetermined current value required for the internal operation of the circuit. If the driver circuit of the voltage generator is not properly driven based on the above-described current, an operational error of the device may occur. In order to overcome the above-described problem, the driver circuit is driven using various error checking units, for example, a FIB (Focused Ion Beam), so that the fabrication cost of the products is increased and the time required for fabricating the products is also increased, for thereby causing an inefficiency in the system.

SUMMARY OF THE INVENTION

Accordingly, it is an object of the present invention to provide a variable voltage driver circuit using a current detector which overcomes the aforementioned problems encountered in the conventional art.

It is another object of the present invention to provide a variable voltage driver circuit using a current detector which is capable of variably driving a driver circuit of a voltage generator by providing an apparatus for detecting the current.

In order to achieve the above objects, there is provided a variable voltage driver circuit using a current detector which includes a voltage generator, a voltage detector for detecting an output voltage of the voltage generator, a delay unit connected with the voltage detector for feeding back a signal to the voltage generator, a pulse generator for receiving a signal from the voltage generator and generating a pulse, a current-pulse generator for detecting a current in accordance with a signal from the pulse generator, a voltage drop detector for detecting a voltage dropped in the signal from the current-pulse generator, a latch for storing a signal from the voltage drop detector, and an extra-voltage driver for supplying a current in accordance with a latch signal when the current is small.

In the present invention, when a normal voltage is generated by the voltage generator, the current supplied to the driver circuit is measured using a current-pulse generator. If the current is small(lack), an extra-voltage driver is driven for thereby generating and supplying a necessary current.

Therefore, in the present invention, the voltage and current used for generating a particular voltage may be monitored for thereby supplying the devices with a proper current.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims as a result of the experiment compared to the conventional arts.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The embodiments of the present invention will be explained with reference to the accompanying drawings.

Figure 1:
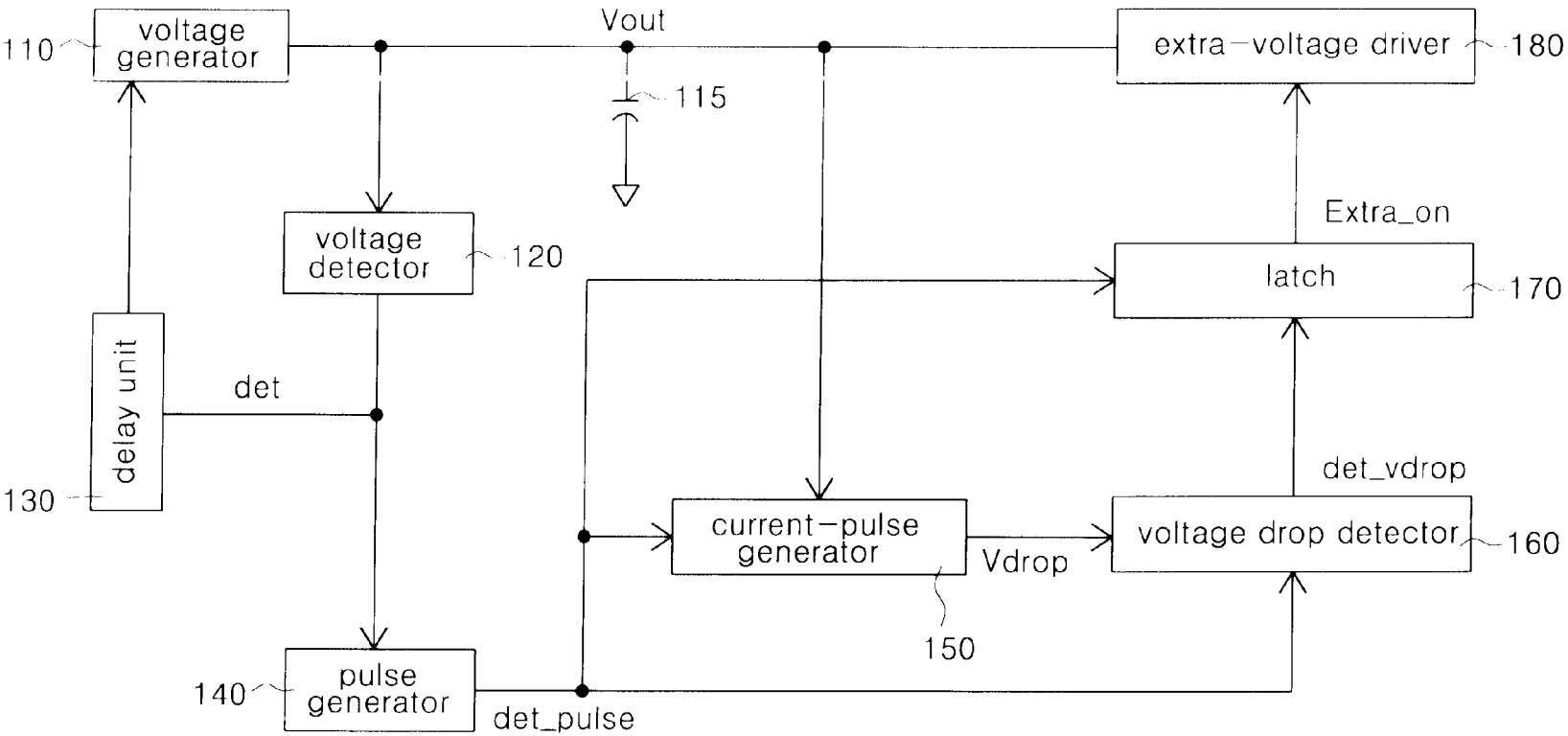
FIG. 1 is a block diagram illustrating a variable voltage driver circuit using a current detector according to the present invention.

FIG. 1 illustrates a variable voltage driver circuit based on a current detector according to the present invention.

As shown therein, the variable voltage circuit based on the current detector includes a voltage generator 110, a voltage detector 120 for detecting an output voltage from the voltage generator 110, a delay unit 130 connected with the voltage detector 120 for feeding back a signal "det" to the voltage generator 110, a pulse generator 140 for receiving a signal from the voltage detector 120 and generating a pulse det_pulse, a voltage capacitor 115 for maintaining a voltage Vout of the voltage generator 110, a current-pulse generator 150 for detecting the current based on the signal det_pulse from the pulse generator 140, a voltage drop detector 160 for detecting the drop of the voltage based on a signal Vdrop from the current-pulse generator 150, a latch 170 for storing the signal from the voltage drop detector 160, and an extra-voltage driver 180 for supplying a current Extra-on in accordance with a signal from the latch 170 when the measured current is small.

In the present invention, in order to overcome the problems encountered in the conventional art, the current-pulse generator 150 capable of detecting the current is provided for variably driving the driver circuit of the voltage generator 110. Namely, when a normal voltage is generated by the voltage generator 110, the current-pulse generator 150, which is a current detector, measures the current supplied to the driver. If the current is small, the extra-voltage driver 180 is driven for thereby supplying a current Extra-on. The current detector 150 may be formed of a conventional voltage detector. When the normal voltage is generated, the thusly generated voltage V is supplied through an external voltage such as a ground voltage or a power voltage and a resistor R during a short time, and then the voltage loss due to the resistor R is measured for thereby measuring the current I based on an equation "V=IR".

Figure 2:
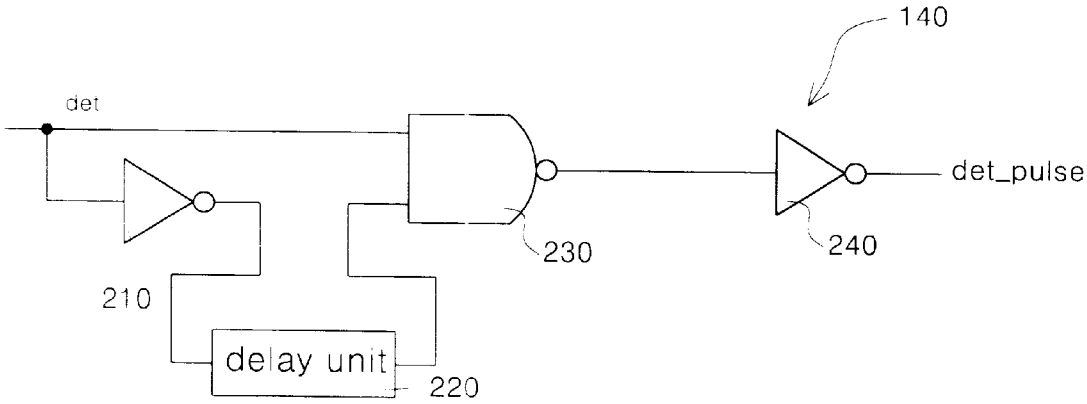
FIG. 2 is a circuit diagram illustrating the pulse generator shown in FIG. 1.
Figure 3:
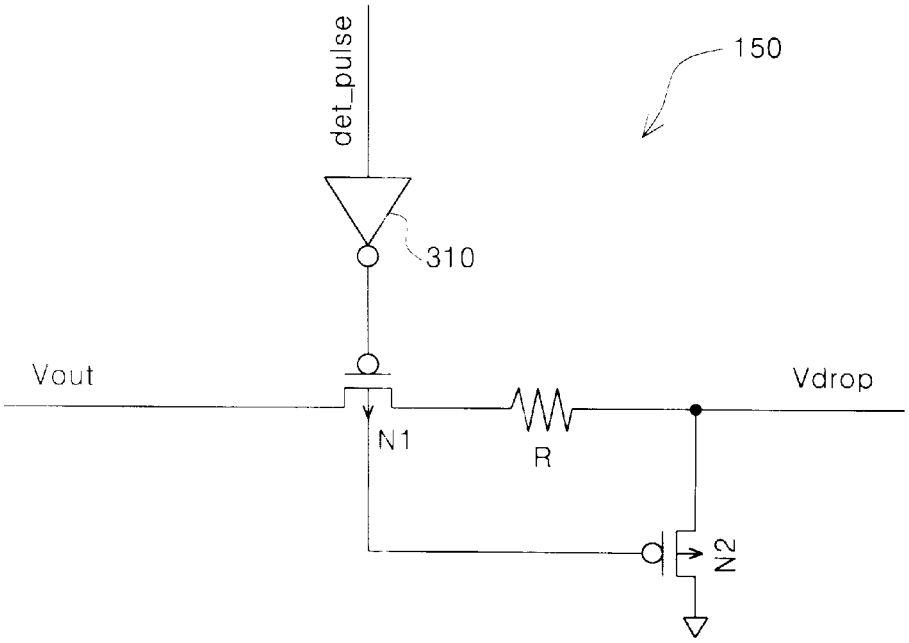
FIG. 3 is a circuit diagram illustrating the currentpulse generator as shown in FIG. 1.

As shown in FIG. 1, the voltage generator 110 and the voltage detector 120 may be formed of a conventional voltage generator, respectively. Namely, when the voltage generates 110 generates a voltage of Vout, the voltage detector 120 detects the normal value of the thusly generated voltage and determines the operational state of the voltage generator 110. In addition, there is provided a delay unit 130 receiving a detection signal "det" from the voltage detector 120 and delaying the signal. The current of Vout is measured during the above-described delay time. The pulse generator 140 receives a normal detection signal from the voltage detector 120 and generates a voltage pulse during a proper time duration. Namely, when Vout has a normal voltage, the signal "det" is enabled to a high voltage, so that "det-pulse" generates a high voltage pulse signal. As shown in FIG. 2, the above-described circuit has a pulse width corresponding to the time delay of the delay unit 220. The thusly generated signal det_pulse is inputted into the current-pulse generator 150 and the voltage drop detector 160, respectively. The current pulse generator as shown in FIG. 3 connects Vout with the ground voltage for thereby generating the current pulse, so that the voltage is dropped by transistors N1 and N2 and the resistor R, and thus the output voltage becomes Vdrop for thus obtaining Vdrop=Vout-Iout*(R+R1) where R1 represents a resistance of the N1 and Iout represents a current supplied to Vout. If Iout is large, Vdrop is small, and if Iout is small, Vdrop is large, so that Vdrop has an information about the current Iout. The thusly generated Vdrop is detected by the voltage drop detector 160 for thereby implementing a latching operation. The above-described operation is performed during the time corresponding to the pulse width after Vout becomes a normal voltage. Since the thusly latched signal Extra_on has an information about the current Iout, if Iout is small, the extra voltage driver 180 is operated for thereby supplying more current.

FIG. 2 illustrates the pulse generator as shown in FIG. 1. As shown therein, the pulse generator includes a first inverter 210 for inverting the detection signal "det" from the voltage detector 12, a delay unit 220 for controlling the pulse width of the signal "det" inverted by the first inverter 210, a NAND-gate 230 for receiving the signal from the delay unit 220 and NANDing the signal, and a second inverter 240 for inverting the signal from the NAND-gate 230.

FIG. 3 illustrates the current-pulse generator as shown in FIG. 1. As shown therein, the current-pulse generator includes an inverter 310 inverting the signal det_pulse from the pulse generator, a PMOS transistor N1 gate-connected in accordance with the signal inverted by the inverter 310 for outputting the output signal Vout of the voltage generator, a PMOS transistor N2 gate-connected in accordance with the signal inverted by the inverter 310 for outputting a ground voltage, and a resistor R connected between the PMOS transistors N1 and N2 for generating Vdrop. Vout is connected with the ground voltage while the pulse signal det_pulse is inputted for thereby generating the current pulse. At this time, the voltage is dropped due to the PMOS transistors N1 and N2 and the resistor R, so that the output voltage becomes Vdrop for thereby obtaining Vdrop=Vout-Iout*(R+R1) where R1 represents a resistance of N1, and Iout represents the current supplied to Vout. If Iout is large, Vdrop is small, and if Iout is small, Vdrop is large, and Vdrop has an information about Iout.

Figure 4:
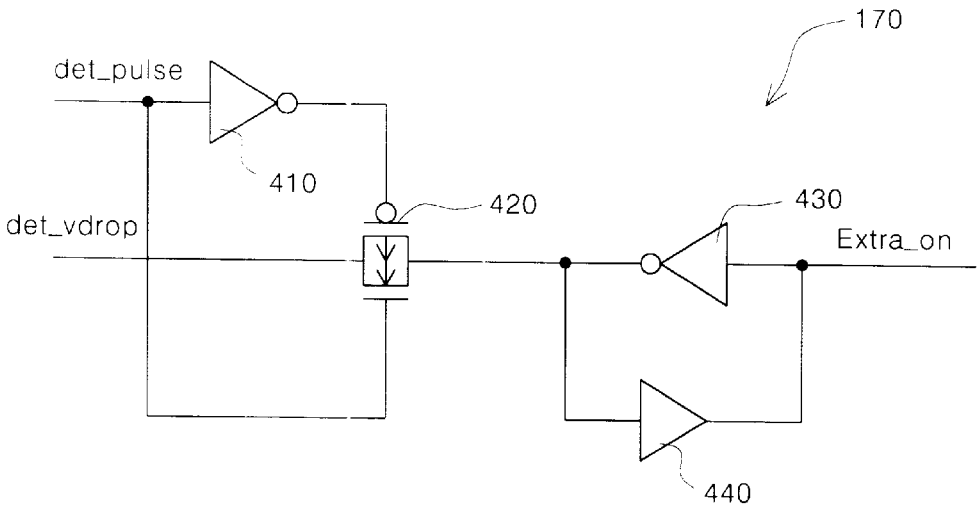
FIG. 4 is a detailed circuit diagram illustrating the latch as shown in FIG. 1.

FIG. 4 illustrates a circuit of the latch as shown in FIG. 1. The latch includes a first inverter 410 for inverting the signal det_pulse from the pulse generator, a transmission gate 420 driven in accordance with a signal from the first inverted for transmitting the signal det_Vdrop of the voltage drop detector, and a second inverter 430 and a third inverter 440 for storing the signal from the transmission gate 420 and generating Extra_on. The latch circuit is a circuit for latching the signal det_Vdrop detecting Vdrop based on the signal det_pulse. The output signal Extra_on enables the extra-voltage driver as shown in FIG. 5.

Figure 5:
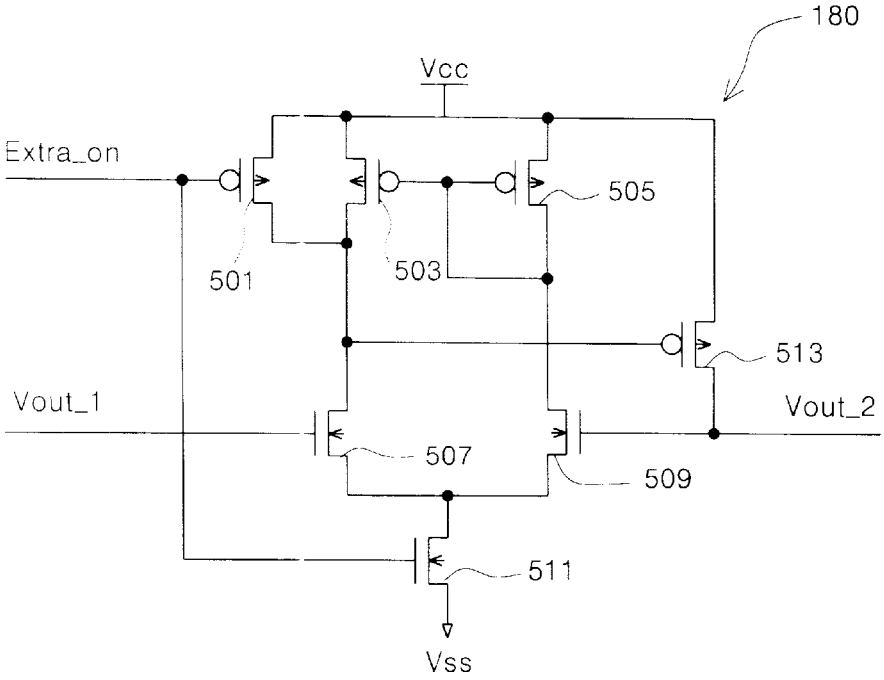
FIG. 5 is a detailed circuit diagram illustrating the extra voltage driver as shown in FIG. 1.

FIG. 5 illustrates the extra-voltage driver as shown in FIG. 1. The extra-voltage driver includes seven transistors 501, 503, 505, 507, 509, 511 and 513. The transistor 507 is driven in accordance with an external control signal Vout_1 and applies a proper current to the node connected with the gate of the transistor 509 and the source of the transistor 513 when the transistors 501 through 511 receiving the signal Extra_on from the latch are driven.

The present invention may be used for various voltage generators. Namely, in the case of DRAM, the present invention is applicable for a voltage-up converter, a voltage-down converter, a substrate-bias generator, a reference voltage generator, etc. In addition, when a fuse type is used for the voltage drop detector, it is possible to detect various current values and implement various current supplies using the same.

Therefore, in the present invention, it is possible to effectively supply a proper current used for the device by monitoring the voltage as well as current used for generating a voltage, for thereby increasing the margin for the device design for thereby implementing a stable operation of the device. The present invention is directed to a new current detection technique which is not disclosed in the conventional art, so that it may be applicable for various fields. In particular, when the current becomes unstable during the operation of the system, the present invention may be applicable for a circuit capable of stabilizing unstable operation of the device.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A variable voltage driver circuit using a current detector, comprising:

a voltage generator;

a voltage detector for detecting an output voltage of the voltage generator;

a delay means connected with the voltage detector for feeding back a signal to the voltage generator;

a pulse generator for receiving a signal from the voltage detector and generating a pulse;

a current-pulse generator for detecting a current in accordance with a signal from the pulse generator;

a voltage drop detector for detecting a voltage dropped in the signal from the current-pulse generator;

a latch for storing a signal from the voltage drop detector; and an extra-voltage driver for supplying an output current in accordance with a latch signal when the current is small.

2. The circuit of claim 1, further comprising a voltage capacitor for maintaining a output voltage of the voltage generator.

3. The circuit of claim 1, wherein when a normal output voltage is generated by the voltage generator, and the current is small as compared to the voltage drop as a result that the current supplied by the driver is measured using the current-pulse generator, the extra-voltage driver is driven for thereby supplying a current.

4. The circuit of claim 1, wherein said current-pulse generator includes:

an inverter for inverting the signal from the pulse generator;

a first PMOS transistor gate-connected in accordance with the signal from the inverter for transmitting the output voltage of the voltage generator;

a resistor connected with the first PMOS transistor; and a second PMOS transistor connected between the resistor and a ground circuit and gate-connected in accordance with the signal from the inverter for supplying a ground voltage, whereby a voltage of a output node connected with the resistor and the second PMOS transistor is maintained to a ground voltage while the pulse signal is inputted into the inverter for thereby generating a current pulse.

* * * * *